US005358133A

United States Patent [19]

Gillispie et al.

[11] Patent Number: 5,358,133

[45] Date of Patent: Oct. 25, 1994

[54] OVER-PACK CONTAINER FOR AN INDUSTRIAL DRUM

[75] Inventors: John G Gillispie; Donald J. Mitchell, both of Wellsburg, W. Va.

[73] Assignee: Eagle Manufacturing Company, Wellsburg, W. Va.

[21] Appl. No.: 36,543

[22] Filed: Mar. 22, 1993

[51] Int. Cl.[5] ..... B65D 41/04

[52] U.S. Cl. ..... 220/304; 220/284; 220/288

[58] Field of Search ..... 220/23.2, 23.6, 288, 220/284, 304, 208, 289, 465, 215; D9/333, 500, 503, 516, 558, 434, 452; 215/356, 357

[56] References Cited

U.S. PATENT DOCUMENTS

| | | | |
|---|---|---|---|
| D. 337,522 | 7/1993 | Kingsbury | D9/559 X |
| 1,569,875 | 1/1926 | Nixon . | |
| 2,727,673 | 12/1955 | Bergstrom . | |
| 3,664,544 | 5/1972 | Hammes . | |
| 3,696,962 | 10/1972 | Fehres et al. . | |
| 4,094,432 | 6/1978 | Zilbert . | |
| 4,453,647 | 6/1984 | Neat | 220/288 |
| 4,648,522 | 3/1987 | Wise . | |
| 4,708,258 | 11/1987 | Shaw et al. . | |
| 4,709,833 | 12/1987 | Granberg et al. . | |
| 4,711,365 | 12/1987 | Fomby . | |
| 4,712,711 | 12/1987 | Geering et al. . | |
| 5,096,083 | 3/1992 | Shaw et al. | 220/288 X |
| 5,147,060 | 9/1992 | Lima et al. . | |
| 5,167,344 | 12/1992 | Van Schilt | 220/288 X |
| 5,180,076 | 1/1993 | Hundt . | |

FOREIGN PATENT DOCUMENTS

| | | | |
|---|---|---|---|
| 133976 | 6/1933 | Austria | 220/288 |
| 1325082 | 3/1963 | France | 220/23.6 |

*Primary Examiner*—Allan N. Shoap
*Assistant Examiner*—Jes F. Pascua
*Attorney, Agent, or Firm*—Armstrong, Westerman, Hattori, McLeland & Naughton

[57] ABSTRACT

An over-pack container for an industrial drum has a body portion with an outwardly extending flange thereon that has a flat outer surface of a polygonal shape and an inwardly extending upper lip that terminates as a downwardly depending leg with threads on the inner surface thereof. A hollow lid has a circular member with threads on the outer wall which engage with the threads of the leg of the body portions, and an outwardly extending portion having a lower sealing surface that engages the lip of the body portion, with upwardly spaced projections about the periphery of the lid.

3 Claims, 5 Drawing Sheets

OVER-PACK CONTAINER FOR AN INDUSTRIAL DRUM

BACKGROUND OF THE INVENTION

The present invention relates to an over-pack container, or salvage drum, for use in containing an industrial drum to prevent spillage and dispersal of the contents of an industrial drum should a leak or spill therefrom occur during shipment or storage.

With the ever increasing concern of environmental damage caused by possible spillage or leakage of solvents and other toxic materials from industrial drums, it has become advisable to ship and store such drums in over-pack containers formed of thermoplastic material. Such over-pack containers are of a size such as to contain the contents of a drum stored therein should the drum leak or fail and thus prevent pollution of the environment by the contents of the drum. Various types of such over-pack containers have been known, for example, those described in U.S. Pat. No. 4,708,258 and U.S. Pat. No. 4,709,833.

In U.S. Pat. No. 4,708,258, a polyethylene salvage drum is shown which has a container with a solid side wall and a double-walled lid. The top portion of the container has male threads on the exterior surface and an enlarged circular portion adjacent the threads. The lid has a skirt depending from a body portion of the lid, with female threads on the interior surface of the lid skirt that co-act with the male threads on the container. In U.S. Pat. No. 4,709,833, another embodiment of a salvage drum is shown, which is rotationally molded from polyethylene, where the drum has a plurality of spaced apart vertical column ribs disposed from the sidewall, an outwardly projecting rim at the open end of the drum, and a double walled recessed lid with a reinforcing bead, with the bead of the lid and the projecting rim of the body secured together by a ring clamp to seal the drum.

It is an object of the present invention to provide an over-pack container for an industrial drum that uses threaded securement of a lid and body portion and improved corner drop strength, as well as other improvements not provided by prior art containers.

SUMMARY OF THE INVENTION

An over-pack container for an industrial drum is comprised of a body portion and lid which are threadedly engaged together to seal an industrial drum stored therein. The body portion has a bottom wall, and a circular sidewall extending upwardly from the bottom wall and terminating at an inwardly extending lip. The lip has a downwardly depending leg portion, spaced from the circular wall, that has an inner surface with female threads thereon, with a gap provided between the downwardly depending leg portion and the circular sidewall. The circular sidewall has a flange portion extending outwardly from the circular sidewall, adjacent the lip, the flange portion having an outer surface of polygonal shape with flat outer surfaces. The flange is preferably octagonal in shape and has a shoulder portion at the lower end, the shoulder portion providing a surface for contact with forks of a forklift for lifting of the container.

The lid comprises a hollow circular member that has an outer wall with male threads thereon that are engageable with the female threads of the body portion, and an outwardly extending portion at the upper region.

The outwardly extending portion of the lid has a lower sealing surface engageable with the inwardly extending upper lip of the body portion and spaced upward projections extending about the periphery of the lid. The lid has an upper wall with radial depressions therein and a lower wall with a circular groove formed therein, with a bottom wall forming the groove merging with the upper wall of the lid to provide strength and reinforcement to the hollow circular member.

BRIEF DESCRIPTION OF THE DRAWINGS

The present invention will be more readily understood by reference to the drawings which illustrate a preferred embodiment of the over-pack container wherein.

DETAILED DESCRIPTION

Figure 1:
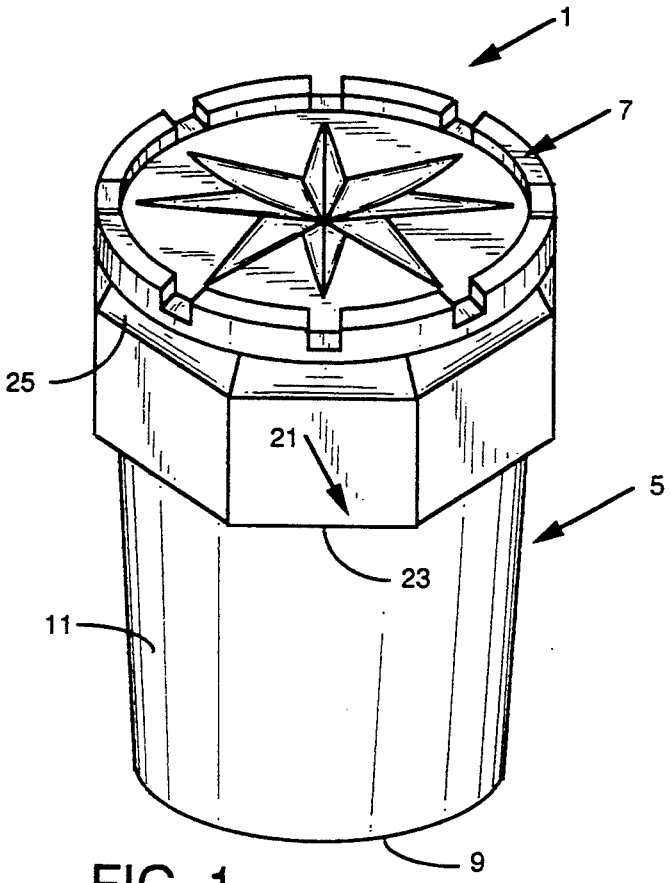
FIG. 1 is an isometric view of the preferred embodiment of the over-pack container of the present invention.
Figure 2:
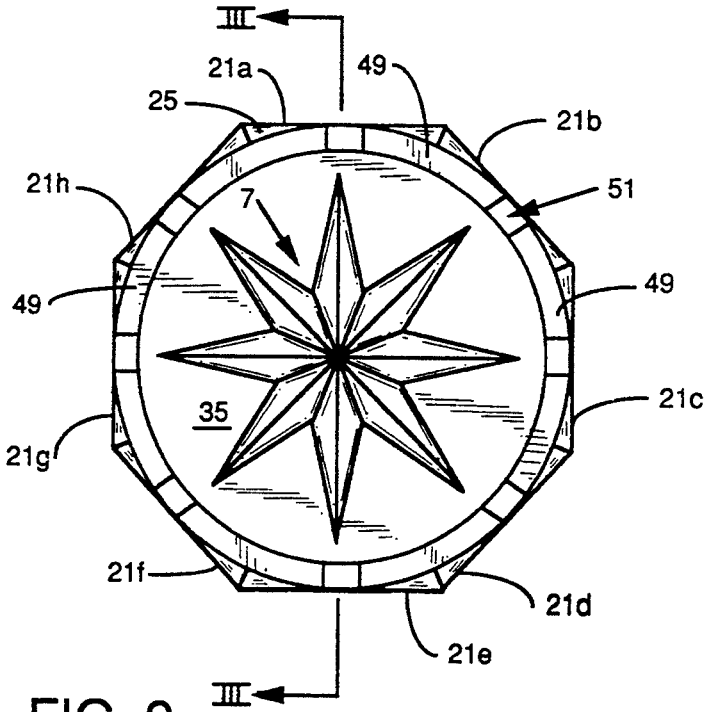
FIG. 2 is a top plan view of the over-pack container of FIG. 1.
Figure 3:
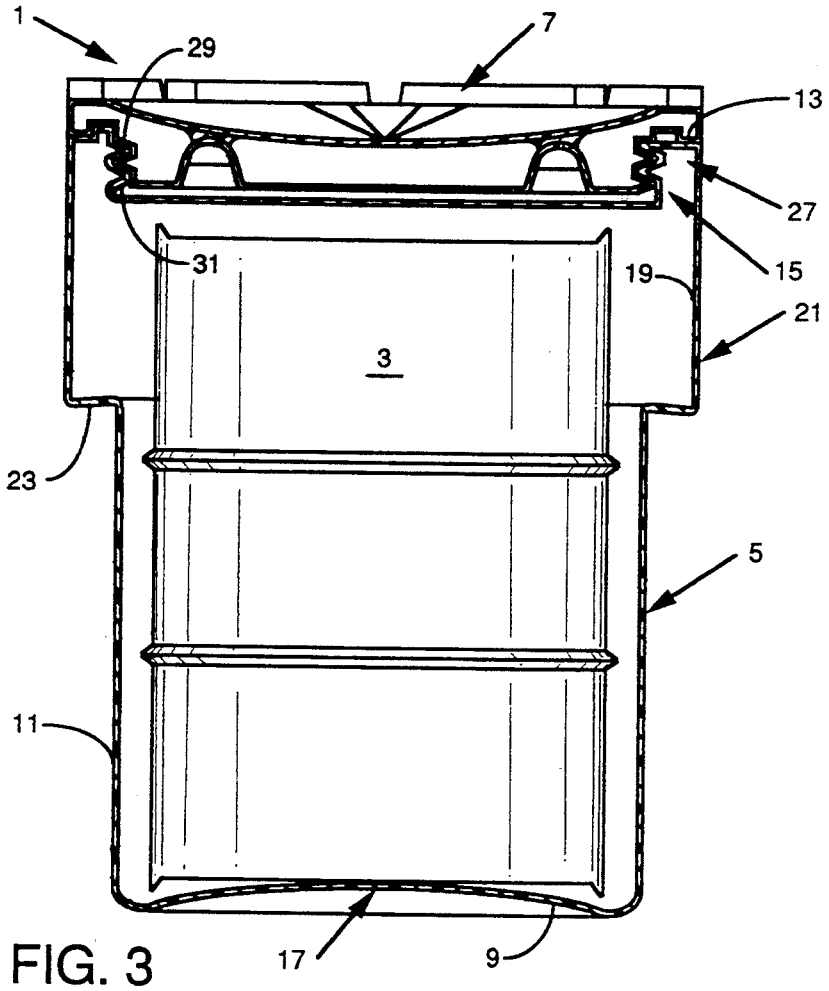
FIG. 3 is a vertical cross-sectional view of the over-pack container taken along lines III—III of FIG. 2 showing an industrial drum contained therein.
Figure 4:
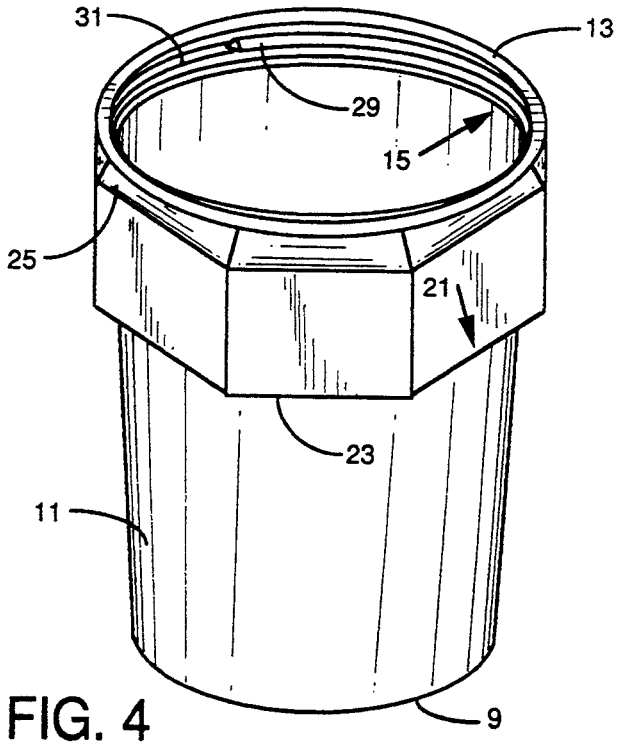
FIG. 4 is an isometric view of the body portion of the over-pack container of FIG. 1.
Figure 5:
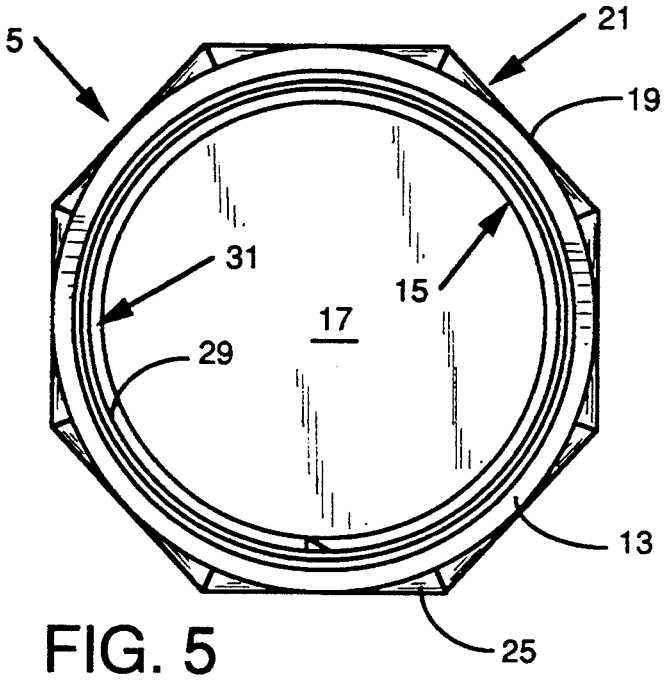
FIG. 5 is a top plan view of the body portion of the overpack container illustrated in FIG. 4.
Figure 6:
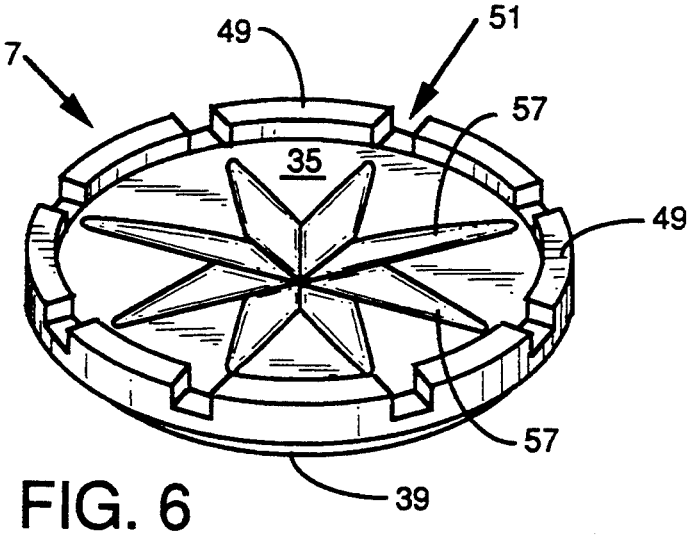
FIG. 6 is an isometric view of the lid of the over-pack container of FIG. 1.
Figure 7:
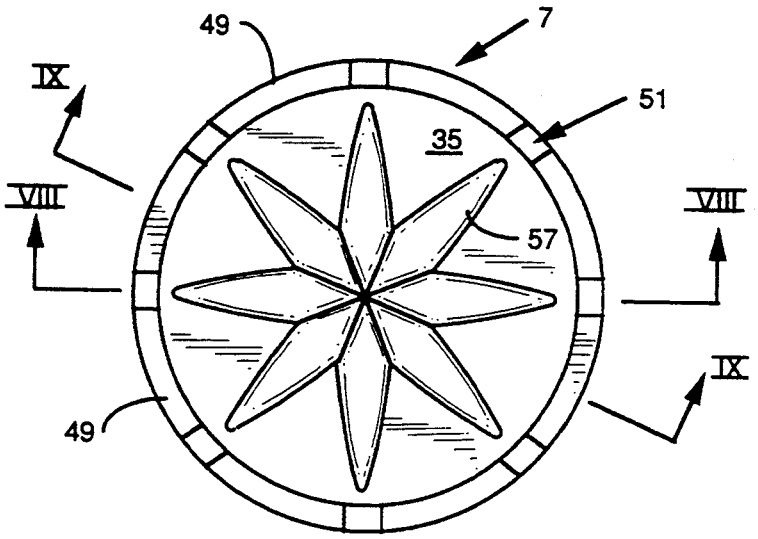
FIG. 7 is a top plan view of the lid of FIG. 6.
Figure 8:
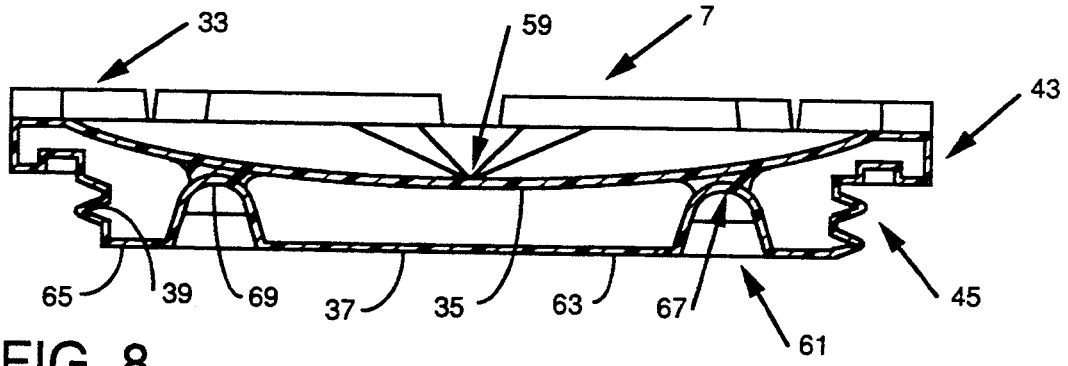
FIG. 8 is a cross-sectional view taken along lines VIII—VIII of FIG. 7.
Figure 9:
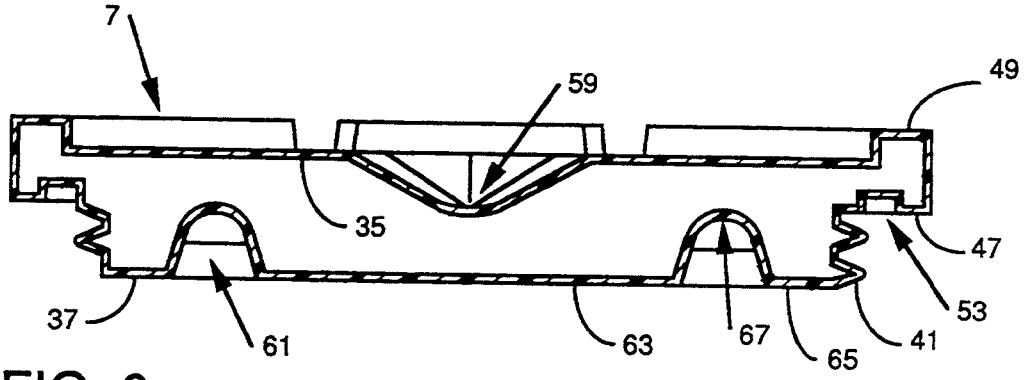
FIG. 9 is a cross-sectional view taken along lines IX—IX of FIG. 7.
Figure 10:
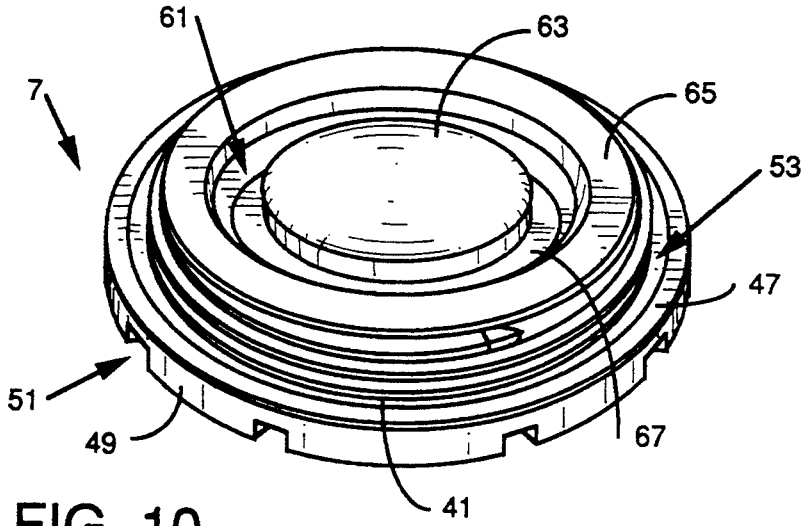
FIG. 10 is a bottom isometric view of the lid of the over-pack container of FIG. 1.

Referring now to the drawings, FIG. 1–3 illustrate an over-pack container 1 for an industrial drum 3, the over-pack container 1 having a body portion 5 and a lid 7.

The body portion 5 comprises a thermoplastic molded unit, for receipt therein of an industrial drum 3, the body portion 5 having a bottom wall 9, and a circular upstanding sidewall 11 extending upwardly from the bottom wall 9, the upstanding sidewall 11 terminating at an inwardly extending upper lip 13 which has a downwardly depending leg portion 15. The bottom wall 9 is preferably concave, as shown at 17 in FIG. 3 so as to cushion the bottom of a drum placed into the body portion 5, while the upstanding sidewall 11 preferably extends upwardly from the bottom wall 9 at a slight outward slope to provide for nesting of body portions 5. The circular upstanding sidewall 11, at a location adjacent the inwardly extending upper lip 13, has an outwardly extending flange portion 19, which outwardly extending flange portion 19 has an outer surface 21 that is not circular but rather of a polygonal shape with connected flat outer surfaces 21*a* . . . 21*x*. In the embodiment illustrated, the outwardly extending flange portion 19 has a polygonal outer surface 21 in the form of an octagon, having flat outer surfaces 21*a*, 21*b*, 21*c*, 21*d*, 21*e*, 21*f*, 21*g* and 21*h*. The outwardly extending flange 19 has an inwardly directed, relatively horizontally extending, shoulder portion 23 at the lower end thereof, while the upper end preferably has an inwardly directed sloped portion 25 extending to the inwardly extending upper lip 13. The downwardly depending leg portion 15 of the inwardly extending upper lip 13 is spaced from the flange portion 19 of the upstanding sidewall 11 to form a gap 27 therebetween, and the downwardly depending leg portion has female threads 29 formed on the inner surface 31 thereof.

By providing flange portion 19 with a polygonal outer surface, such as an octagonal surface, important advantages are provided. The filled over-pack containers, when stored or packed for shipping by truck, for example, will fit flush against one another, with a flat surface of one over-pack container flush against a flat surface of an adjacent over-pack container and reduce shifting of the containers during shipping. Also, should an over-pack container, for some reason be tipped so as to be on its side, the over-pack container will not roll as would a completely circular walled container. Also, the flat surface would prevent rolling of the over-pack container if, with the lid removed, the body portion were placed on its side for sliding of a drum into the body portion. In addition, the flat surfaced portion of the flange will provide more surface area along the shoulder 23 of the lower end of the flange 19 for secure contact and lifting of the body portion by forks of a fork lift pickup.

Figure 11:
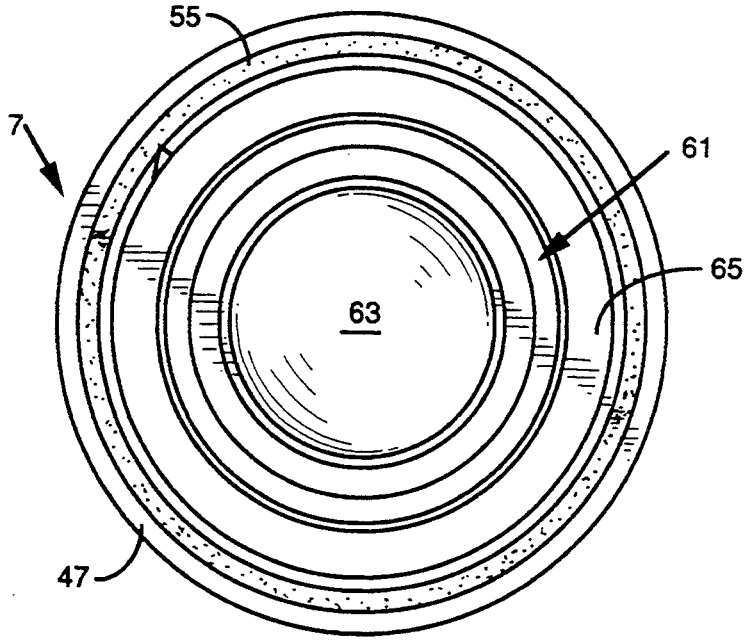
FIG. 11 is a bottom plan view of the lid of FIG. 10.
Figure 12:
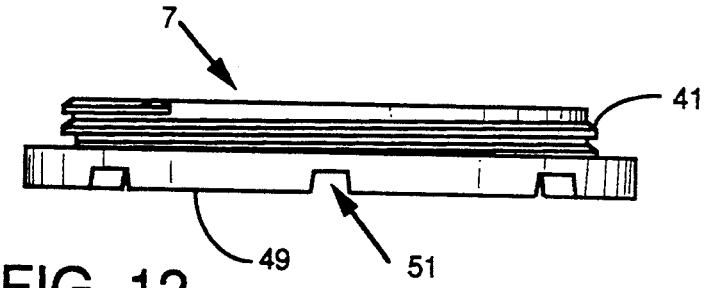
FIG. 12 is a side view of the lid of FIG. 10.

The lid 7 comprises a hollow circular member 33 with upper wall 35, lower wall 37 and circular threaded outer wall 39 having male threads 41 thereon. An outwardly extending portion 43 extends outwardly at the upper region 45 of the circular threaded outer wall 39 and has a lower sealing surface 47 and a plurality of hollow spaced projections 49 extending upwardly about the periphery thereof, with channels 51 provided between the hollow projection 49. A recess 53 is provided in the lower sealing surface 47 of the outwardly extending portion 43 into which a sealing gasket 55 (FIG. 11) may be secured either by a friction fit, adhesive, or other means.

The upper wall 35 of lid 7 is preferably of a concave shape with radially extending depressions 57 therein which extend from a center area 59 outwardly towards the channels 51. The lower wall 37 of lid 7 has a circular groove 61 formed therein which divides the lower-wall 37 into a central cup-shaped section 63 and an outer ring-shaped section 65. The bottom wall 67 forming groove 61 merges at spaced locations with the depressions 57 in the upper wall 35 of the lid 7 to provide reinforced sections 69 and provide strength and resistance to bending.

The provision of the male threads 41 on the lid 7 which are threadedly engaged with the female threads 29 of the body portion 5 provides for a tighter seal therebetween where the contents of a sealed over-pack container 1 produces an internal pressure since the pressure will extend into the gap 27 and force the body portion female threads 29 into tighter engagement with the lid male threads 41. Also, with male threads 41 on the lid 7 and female threads 29 on the body portion 5, a better drop strength is provided since the upper region of the body portion 5 cannot crush inwardly and away from the lid 7 when a top corner drop is effected.

What is claimed is:

1. An over-pack container for an industrial drum comprising:

a body portion for receipt of a drum, said body portion having a bottom wall, a circular sidewall extending upwardly from said bottom wall and terminating at an inwardly extending upper lip, said upper lip having a downwardly depending leg portion, said downwardly depending leg portion being spaced from said sidewall of said body portion to form a gap therebetween and having an inner surface with threads formed thereon, and said circular sidewall having an outwardly extending flange portion adjacent said upper lip, said flange portion having an outer surface or a polygonal shape with flat outer surfaces; and a lid comprising a hollow circular member having a threaded outer wall with threads thereon engageable with the threads of said inner surface of the downwardly depending leg portion of said body portion sidewall, said hollow circular member having an outwardly extending portion at an upper region thereof; said outwardly extending portion having a lower sealing surface engageable with the inwardly extending upper lip of the sidewall of said body portion, with spaced projections extending upwardly about the periphery thereof, and said hollow circular member having an upper wall spaced from a lower wall, with radially extending depressions in said upper wall and a circular groove in said lower wall, with a bottom wall in said lower wall forming said circular groove merging with said depressions in said upper wall to provide reinforced sections.

2. An over-pack container for an industrial drum as defined in claim 1 wherein said outwardly extending flange portion on the outer surface of said circular sidewall has eight flat outer surfaces to form an octagonal surface thereof.

3. An over-pack container for an industrial drum as defined in claim 2 wherein the outwardly extending portion at the upper region of said hollow circular member of said lid has a recess formed therein and a sealing gasket secured in said recess to contact said inwardly directed lip of said body portion and seal the contents of said over-pack container when said lid is threadedly engaged with said body portion.

* * * * *